US007322285B1

(12) United States Patent
Wittig

(10) Patent No.: US 7,322,285 B1
(45) Date of Patent: Jan. 29, 2008

(54) MECHANIZED CAN CRUSHING APPARATUS

(75) Inventor: David Wittig, Maiden Rock, WI (US)

(73) Assignee: Wittig Electric Can Crusher, LLC, Maiden Rock, WI (US)

( * ) Notice: Subject to any disclaimer, the term of this patent is extended or adjusted under 35 U.S.C. 154(b) by 0 days.

(21) Appl. No.: 11/535,820

(22) Filed: Sep. 27, 2006

Related U.S. Application Data

(60) Provisional application No. 60/721,253, filed on Sep. 28, 2005.

(51) Int. Cl.
*B30B 9/32* (2006.01)
*B30B 3/04* (2006.01)

(52) U.S. Cl. ..... 100/98 R; 100/172; 100/173; 100/176; 100/902; 100/171; 241/99

(58) Field of Classification Search ..... 100/98 R, 100/155 R, 168, 171, 172, 173, 176, 902; 241/235, 99
See application file for complete search history.

(56) References Cited

U.S. PATENT DOCUMENTS

| | | | | |
|---|---|---|---|---|
| 5,186,331 | A * | 2/1993 | Valster | 209/3.1 |
| 5,211,109 | A * | 5/1993 | Determan | 100/98 R |
| 5,890,424 | A * | 4/1999 | Deters | 100/37 |
| 6,571,695 | B1 * | 6/2003 | Holmen et al. | 100/155 R |
| 2002/0100376 | A1 * | 8/2002 | Schell et al. | 100/49 |

* cited by examiner

*Primary Examiner*—Jimmy T. Nguyen
(74) *Attorney, Agent, or Firm*—Haugen Law Firm PLLP

(57) ABSTRACT

An apparatus for crushing objects includes an inlet for serially feeding objects to the apparatus and a driver roller that is rotatably driven about a first axis by a power input mechanism, wherein the driver roller has a first notch. The apparatus further includes an idler roller rotatably coupled to the driver roller so as to be rotatably driven about a second axis that is substantially parallel to the first axis. The idler roller has a second notch wherein the first and second notches coordinate to at least partially receive the object therein throughout a portion of respective revolutions of the driver roller and the idler roller. The apparatus may further include a crushed object outlet.

11 Claims, 8 Drawing Sheets

13
22
24
10
12
16
28
14

30
16
32
28
15
14
29

MECHANIZED CAN CRUSHING APPARATUS

CROSS-REFERENCE TO RELATED APPLICATIONS

This application claims priority to U.S. Provisional Patent Application Ser. No. 60/721,253, filed on Sep. 28, 2005, and entitled "MECHANIZED CAN CRUSHING APPARATUS", the content of which is incorporated herein in its entirety.

FIELD OF THE INVENTION

The present invention relates to can crushing devices generally, and more particularly to a mechanized can crushing apparatus that incorporates a design specifically configured to assist in reliably and consistently grasping and crushing cans sequentially fed to the apparatus.

BACKGROUND OF THE INVENTION

Manual and mechanized can crushing devices of various designs have been implemented for facilitating the compaction of, for example, aluminum beverage cans and the like. Many of such conventional devices, however, are either exceedingly large or fail to provide a simple mechanism for reliably grasping and crushing the incoming can.

It is therefore a principal object of the present invention to provide a relatively compact can crushing apparatus that is specifically configured to reliably and consistently grasp and crush incoming cans.

SUMMARY OF THE INVENTION

By means of the present invention, an apparatus and method are provided for mechanically crushing objects, such as aluminum beverage cans. The apparatus utilizes rotating bodies operably placed in biased juxtaposition relative to one another, with such rotating bodies being effective in grasping and crushing objects that are dispersed therebetween. In order to enhance the collection and crushing of target objects, the rotating bodies include notches that at least partially receive the object therein. The coordination of such notches is timed through a selective timing mechanism, with such timing being offset in some embodiments to assist in the crushing process.

In a particular embodiment, the apparatus for crushing objects includes an inlet for serially feeding objects to the apparatus and a driver roller being rotatably driven about a first axis by a power input mechanism, with the driver roller having a first notch. The apparatus further includes an idler roller rotatably coupled to the driver roller so as to be rotatably driven about a second axis that is substantially parallel to the first axis. The idler roller includes a second notch wherein the first and second notches coordinate to at least partially receive the object therein throughout a portion of respective revolutions of the driver roller and the idler roller. The apparatus may further include a crushed object outlet for dispatching of the objects after passage through the crushing apparatus.

DETAILED DESCRIPTION OF THE PREFERRED EMBODIMENTS

The objects and advantages enumerated above together with other objects, features, and advances represented by the present invention will now be presented in terms of detailed embodiments described with reference to the attached drawing figures which are intended to be representative of various possible embodiments of the invention. Other embodiments and aspects of the invention are recognized as being within the grasp of those having ordinary skill in the art.

Figure 1:
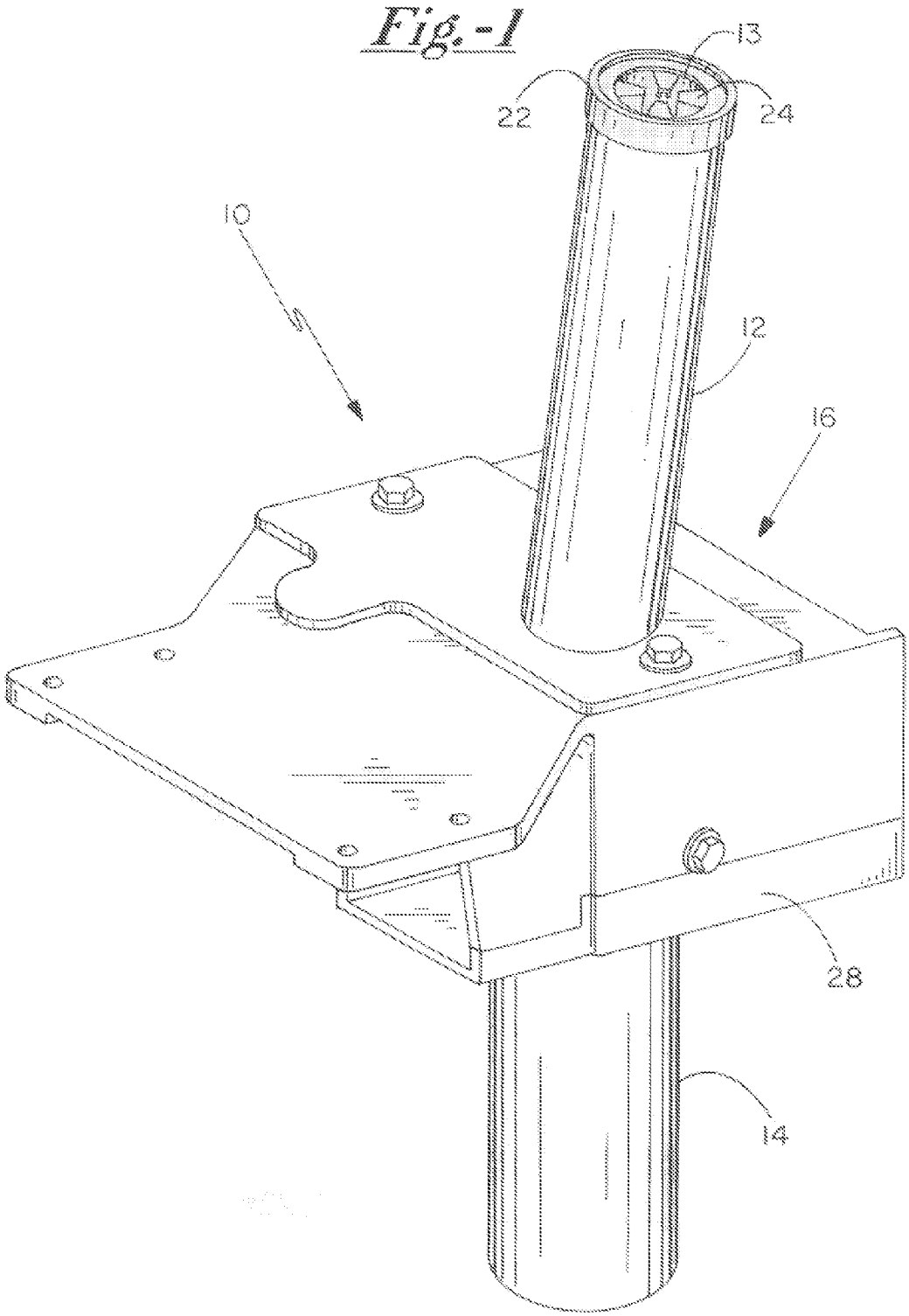
FIG. 1 is a perspective view of a mechanized crushing apparatus of the present invention.

With reference now to the drawing figures, and first to FIG. 1, a mechanized can crushing apparatus 10 of the present invention includes an inlet chute 12, an outlet chute 14, and a crushing assembly 16. In this arrangement, items such as cans to be crushed are fed to apparatus 10 at inlet 13 of inlet chute 12, and are ejected from apparatus 10 in crushed form through outlet chute 14.

As shown in FIG. 1, inlet 13 of inlet chute 12 is preferably at least partially covered by a safety cap 22 which enables the input therethrough of items to be crushed while preventing uncrushed or partially crushed cans from being propelled out through inlet 13 by the force of crushing assembly 16. Preferably, safety cap 22 is fabricated from a relatively resilient material such as rubber, and has flaps 24 that may be forcibly depressed to provide entry to inlet chute 12, while preventing undesired kick-back of material from crushing assembly 16 therethrough. In such a manner, safety cap 22 facilitates safe operation of apparatus 10, such that projectiles do not undesirably exit out from inlet chute 12 where an operator may be positioned.

Figure 2:
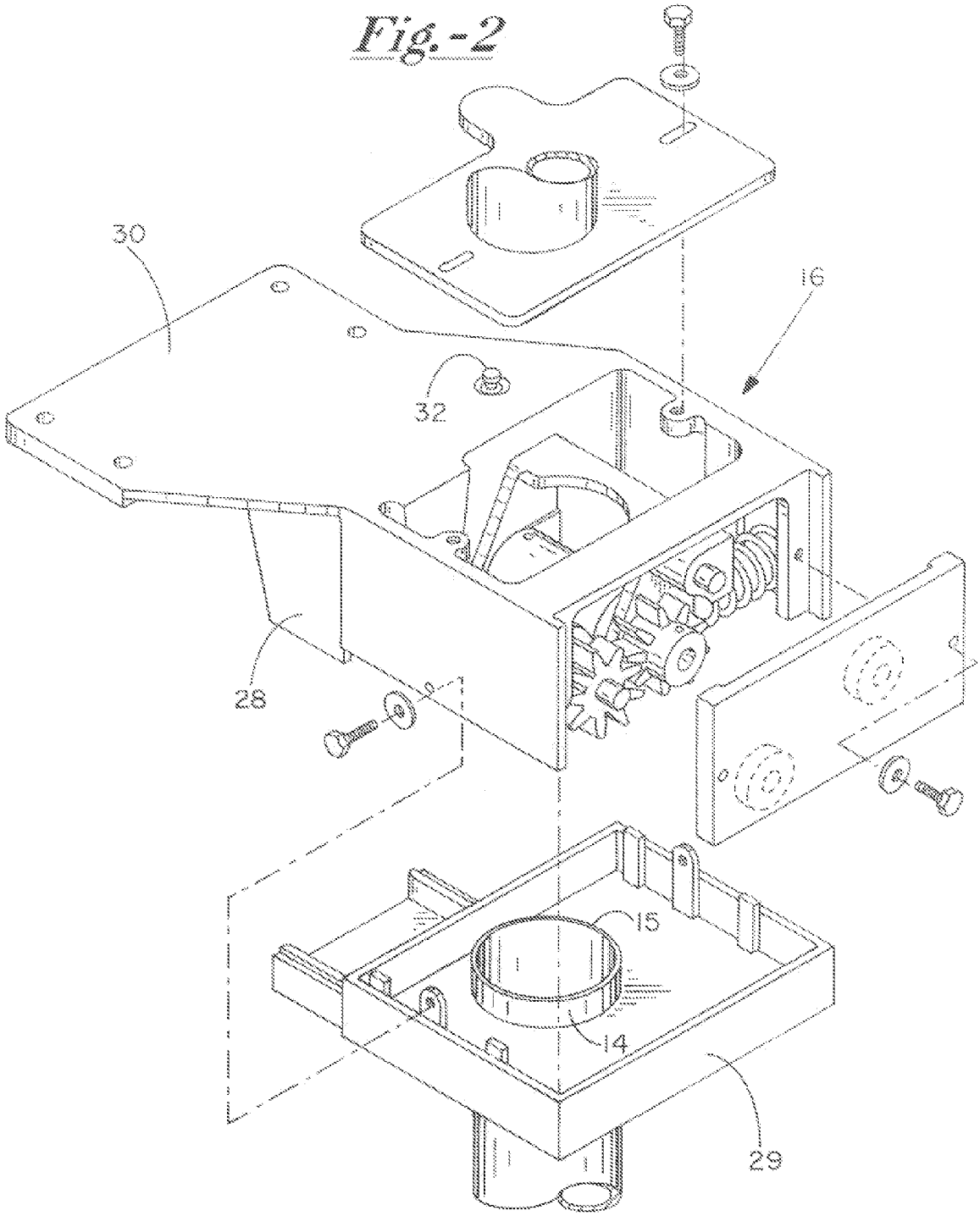
FIG. 2 is an exploded view of a portion of the mechanized crushing apparatus illustrated in FIG. 1.

A partial assembly view of crushing assembly 16 is illustrated in FIG. 2. As shown therein, assembly 16 includes a housing 28 that, when assembled, encloses the mechanism that accomplishes the crushing procedure. Housing 28 is preferably fabricated from a strong and durable material, such as metals like steel or aluminum. A mounting flange 30 extends from housing 28 and is configured to operably mount to a drive motor (not shown). The drive motor is preferably electrically powered, and may specifically be a one-quarter horse power electric gear motor available from Dayton Motor Company. Other types of output motors are contemplated as being useful in the present invention, with the motor being utilized to rotatably drive the crushing mechanism of the apparatus of the present invention.

As further illustrated in FIG. 2, crushing assembly 16 preferably includes an actuator button 32 that is operably coupled to the drive motor for selectively initiating operation of the motor and, consequently, the crushing mechanism within crushing assembly 16. Actuator button 32 therefore preferably electrically engages and disengages the drive motor upon user selection thereof.

As further illustrated in FIG. 2, outlet chute 14 is positioned within bottom section 29 of housing 28 so as to be in adjacent juxtaposition with the crushing mechanism of assembly 16. In such an operable orientation, receiving end 15 of outlet chute 14 has the operable effect of ensuring that crushed items exiting from the crushing mechanism enter into outlet chute 14. In effect, receiving end 15 of outlet chute 14 acts to operably "scrape" the crushed items from the crushing mechanism as they exit therefrom. Such a characteristic prevents crushed items from becoming jammed in other parts of crushing assembly 16.

Figure 3:
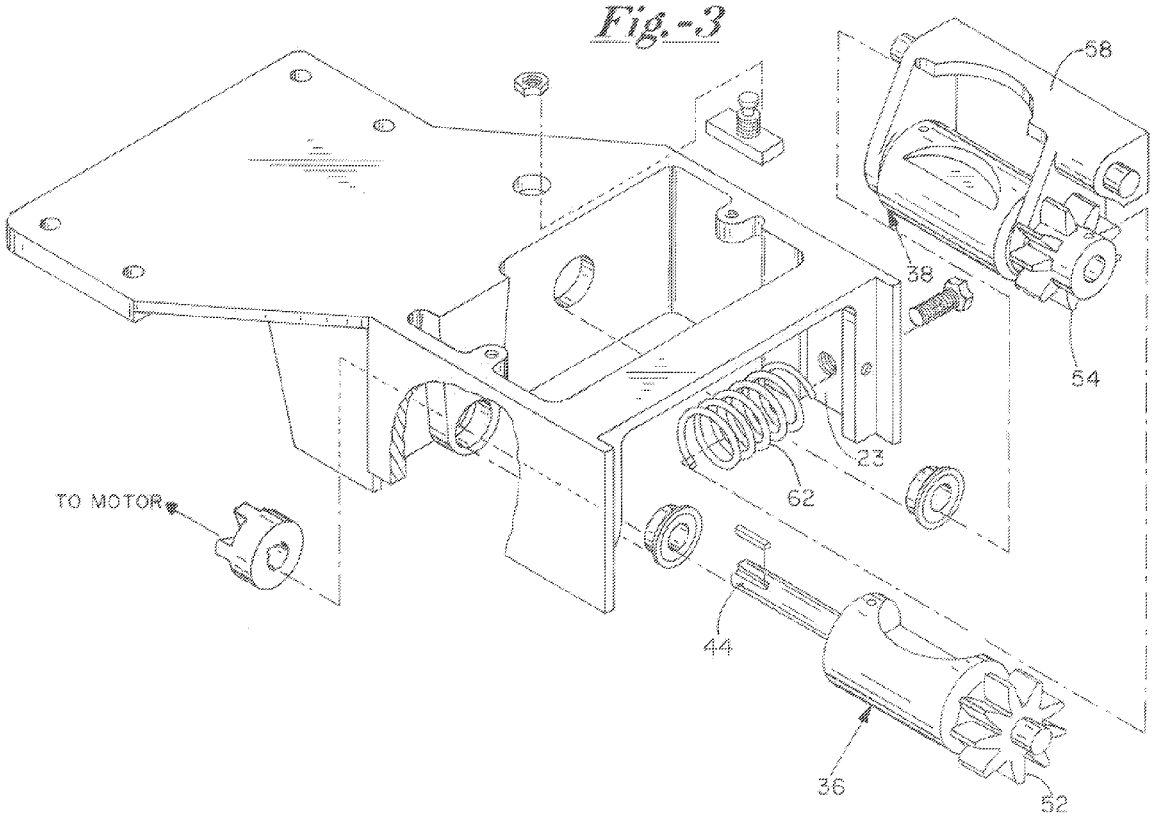
FIG. 3 is an exploded view of a portion of the mechanized crushing apparatus illustrated in FIGS. 1 and 2.

A portion of the assembly illustrated in FIG. 2 is shown in assembly view in FIG. 3. In particular, the crushing mechanism is illustrated as including a driver roller 36 and an idler roller 38 being coupled to one another through respective gears 52, 54 to synchronize rotation thereof. Driver and idler rollers 36, 38 are operably positioned adjacent to one another so as to crush items passing therebetween. As such, items entering crushing assembly 16 through inlet chute 12 are fed to driver and idler rollers 36, 38, and are thereafter drawn between adjacent opposed surfaces 37, 39 of such driver and idler rollers 36, 38 to be crushed.

Figure 4A:
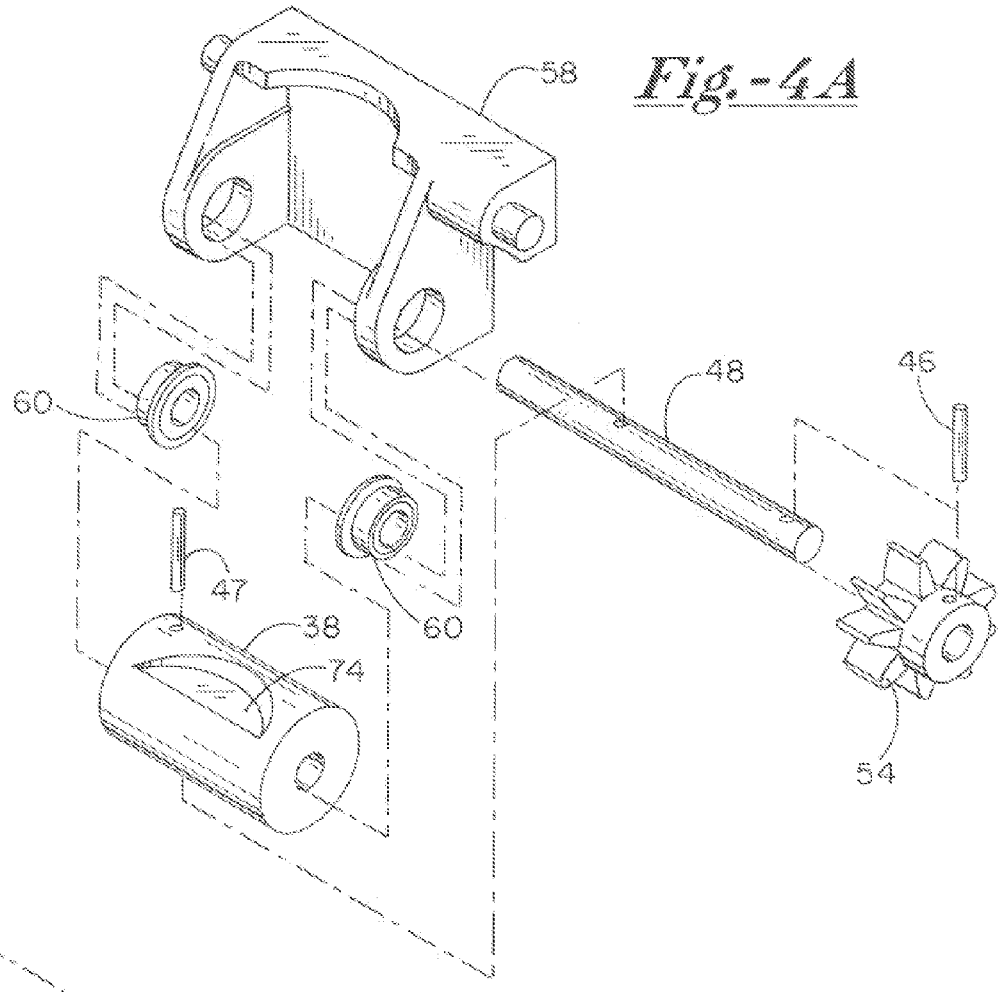
FIG. 4A is an exploded component view of a portion of the mechanized crushing apparatus illustrated in FIGS. 1-3.
Figure 4B:
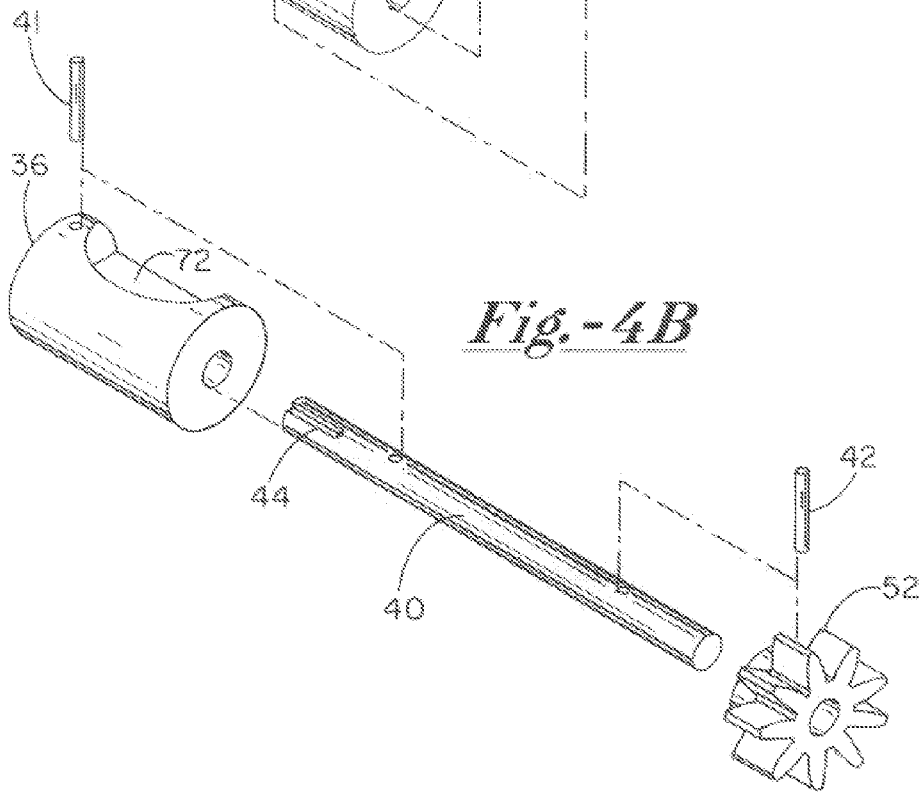
FIG. 4B is an exploded component view of a portion of the mechanized crushing apparatus illustrated in FIGS. 1-3.
Figure 5:
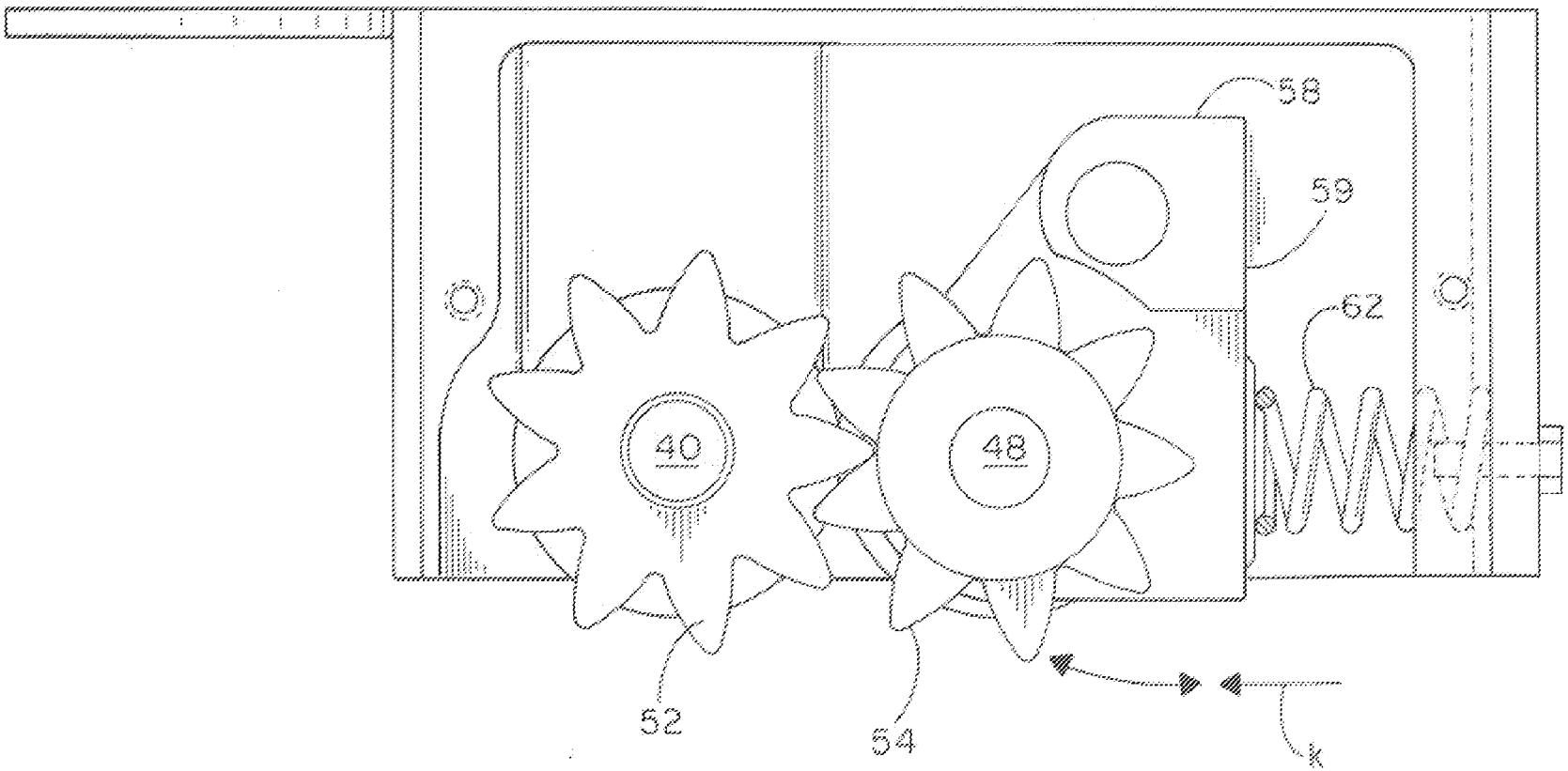
FIG. 5 is a side isolation view of a portion of the mechanized crushing apparatus illustrated in FIGS. 1-3.

As shown in FIGS. 3-5, driver roller 36 is preferably mounted upon first drive shaft 40 in fixed relative relationship therewith. Such a mounting relationship is enabled by pin 41 extending through respective apertures in driver roller 36 and first drive shaft 40. Gear 52 is also mounted to first drive shaft 40 in fixed relative relationship via pin 42 extending through respective apertures in gear 52 and first drive shaft 40.

Preferably, first drive shaft 40 is rotatably driven by the drive motor at first end 44 thereof. In preferred embodiments, the drive motor operationally rotates first drive shaft 40 at between about 5 and 100 RPM, and more preferably between about 20 and 40 RPM. Applicant has determined that such a rotational speed provides desired results in crushing items passing through assembly 16. Due to the fixed relative relationship between gear 52 and first drive shaft 40, as well as the arrangement illustrated in FIG. 5, rotation of first drive shaft 40 causes gear 52 to operably rotate therewith, and further causes gear 54 to rotate in synchronization with gear 52.

Preferably, both gear 54 and idler roller 38 are secured to second drive shaft 48 via pins 46, 47 extending through respective apertures therein. In such a manner, second drive shaft 48 and idler roller 38 are operably rotated in synchronization with driver roller 36 and first drive shaft 40. As illustrated in FIG. 4, idler roller 38 is mounted on second drive shaft 48 within a brace member 58, with idler roller 38 and second drive shaft 48 being rotatably secured to brace member 58 via roller bearings 60. Accordingly, idler roller 38 substantially freely rotates with respect to brace member 58.

Figure 6A:
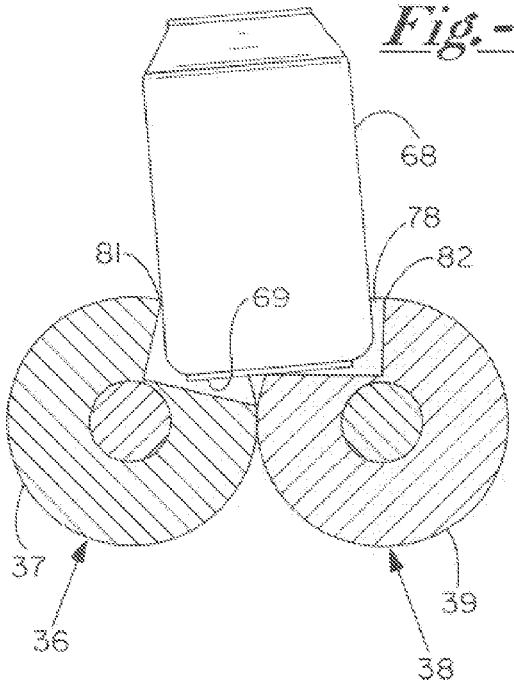
FIG. 6A is a schematic view of a crushing operation performed by the mechanized crushing apparatus illustrated in FIGS. 1-3.
Figure 6B:
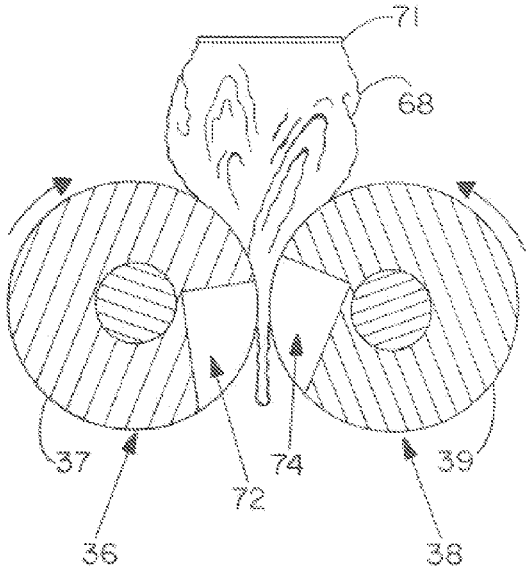
FIG. 6B is a schematic view of a crushing operation performed by the mechanized crushing apparatus illustrated in FIGS. 1-3.
Figure 6C:
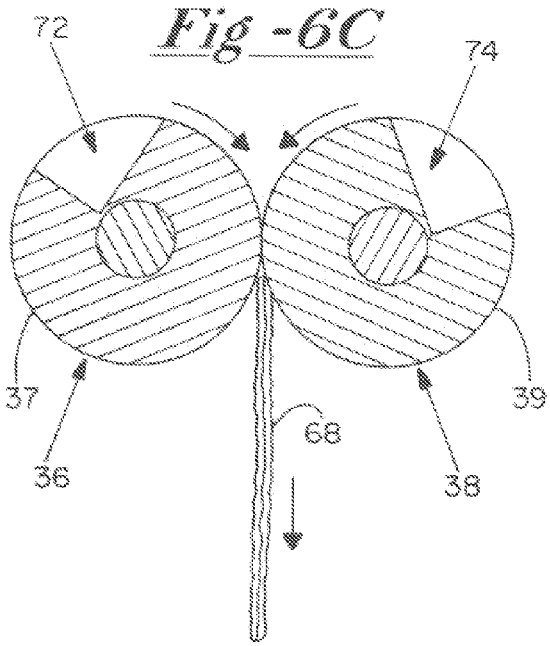
FIG. 6C is a schematic view of a crushing operation performed by the mechanized crushing apparatus illustrated in FIGS. 1-3.

Driver and idler rollers 36, 38 perform the crushing function by drawing an item to be crushed 68 between respective opposed surfaces 37, 39 thereof which are in adjacent operable proximity to one another. This procedure is illustrated in FIGS. 6A-6C, wherein item 68 is crushed between the rotating facing surfaces of driver and idler rollers 36, 38. During the crushing procedure, however, the material of item 68 forces apart driver and idler rollers 36, 38. In order to provide a resistive force to this separation tendency, a bias spring 62 is mounted between rear surface 59 of brace member 58 and inner surface 23 of housing 22. Bias spring 62 is oriented to provide a restorative force "K" along a direction opposite that of the direction in which idler roller 38, and consequently brace member 58, are forced during the crushing operation. Preferably, driver roller 36 is rotatably mounted on a fixed axis so that only idler roller 38 is laterally displaced during the crushing mechanism. Bias spring 62 is preferably calibrated to provide a quantitative force "K" that is sufficient to maintain idler roller 38 in forcible contact with item 68 during the crushing process illustrated in FIGS. 6A-6C. Bias spring 62 may be interchangeable so as to provide the appropriate restorative force necessary to properly engage driver and idler rollers 36, 38 to item 68 during the crushing process, depending upon the material of item 68. In other words, a higher restorative force "K" may be required where a material of item 68 exhibits a higher level of rigidity, and vice versa.

An important aspect of the present invention is in the provision of a pre-set relative rotational position as between driver and idler rollers 36, 38. As illustrated in FIG. 4, the respective positions of driver and idler rollers 36, 38 upon first and second drive shafts 40, 48 is determined by the location of the respective pin apertures in first and second drive shafts 40, 48. As such, the relative rotating orientation of notches 72, 74 in driver and idler rollers 36, 38 may be arranged as desired, and most preferably in a slightly offset orientation that is illustrated in FIGS. 6A-6C.

Applicant has determined that notches 72, 74 in driver and idler rollers 36, 38 assist in retainably receiving item 68 therein. Specifically, since driver and idler rollers 36, 38 operably rotate in opposite directions about their respective axis, notches 72, 74 initially form a reception zone 78 in which item 68 is initially received. Thereafter, respective grasping edges 81, 82 of driver and idler rollers 36, 38 come into contact with item 68 so as to operably grasp item 68 therebetween. Moreover, the opposite rotation of driver and idler rollers 36, 38 enable first and second grasping edges 81, 82 to operably create a relatively sharp point of impact to thereby form respective creases in item 68 to initiate the crushing process. The sharp points of impact further assist in grasping and pulling item 68 into a position between respective opposed surfaces 37, 39 of driver and idler rollers 36, 38.

The pre-set relative rotational position aspect of the present invention further enables notches 72, 74 to be somewhat offset from one another in the respective rotation cycles of driver and idler rollers 36, 38. In doing so, item 68 is initially slightly tilted in reception zone 78, such that bottom portion 69 of item 68 may be more easily initially crushed. Conventional crushing mechanisms often times find difficulty in creating an initial crush point from which to effectively crush the bottom of the item at issue. The operable rotational offset relationship of driver and idler rollers 36, 38 enabled through the pre-set positions of driver and idler rollers 36, 38 on their respective drive shafts 40, 48 timing addresses this drawback encountered in systems of the prior art.

Figure 7:
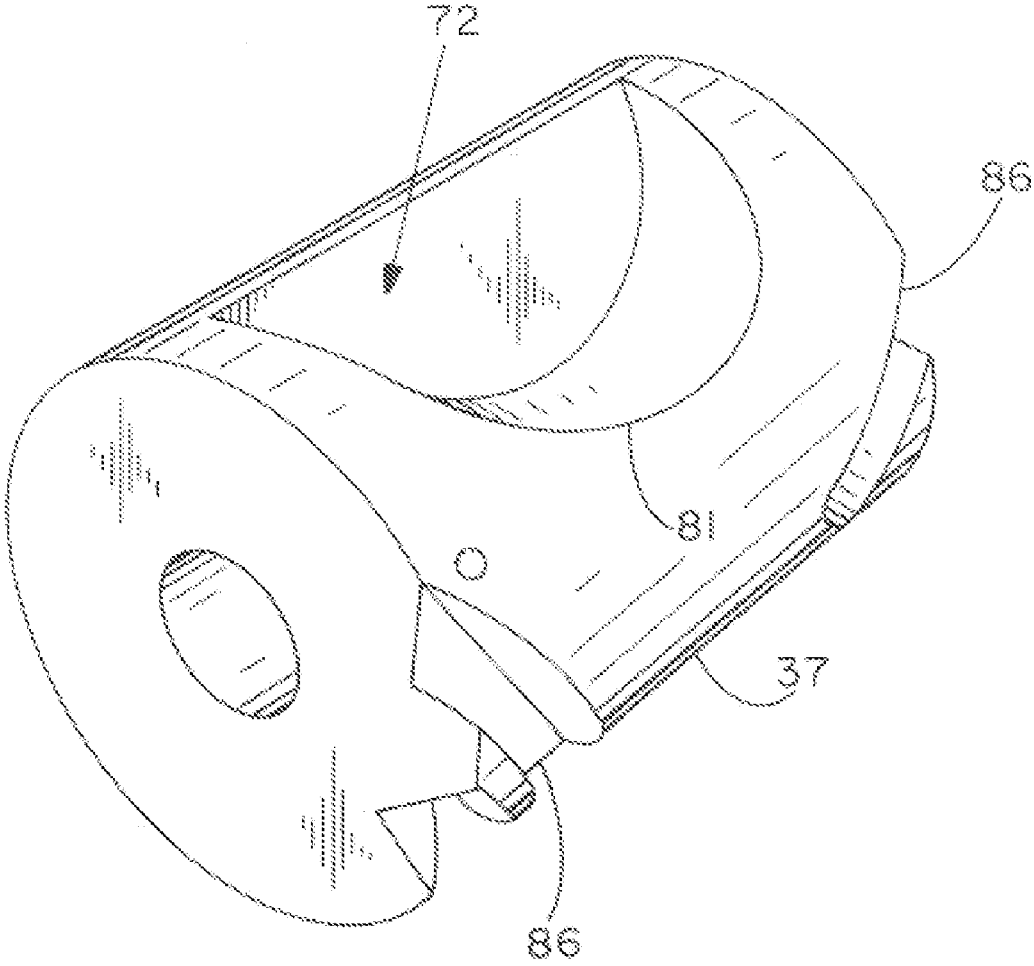
FIG. 7 is an isometric isolation view of a component of the mechanized crushing apparatus illustrated in FIGS. 1-3 and 4B.
Figure 8A:
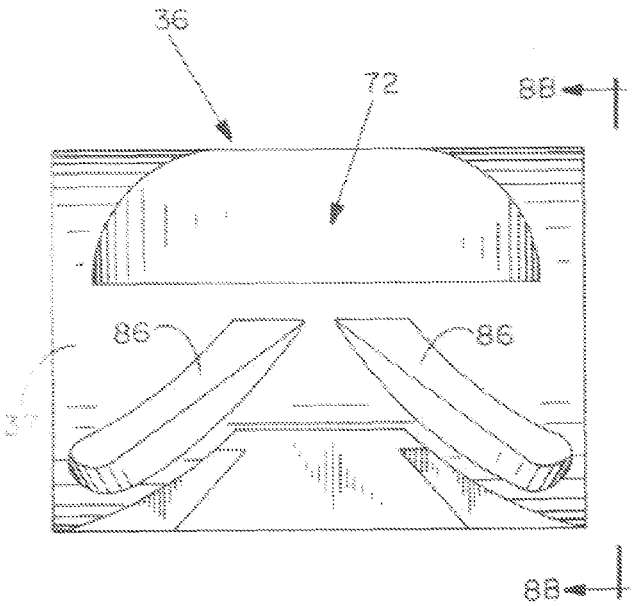
FIG. 8A is a side view of the component of the mechanized crushing apparatus illustrated in FIG. 7.
Figure 8B:
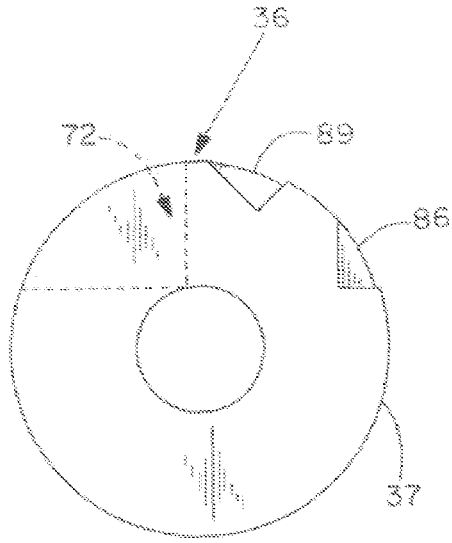
FIG. 8B is an end view of the component of the mechanized crushing apparatus illustrated in FIGS. 7 and 8A.

An example of an idler roller surface configuration is illustrated in FIGS. 7, 8A and 8B, wherein driver roller 36 includes a notch portion 72 that defines a portion of reception zone 78 illustrated in FIG. 6A. Grasping edge 81 serves to initially operably grasp item 68, and to form an initial crease therein for pulling item 68 through the crushing mechanism. A further important aspect of driver and idler rollers 36, 38 is the provision of gripping channels 86 formed in outer surface 37 thereof. Such gripping channels 86 are specifically configured to assist in grasping item 68 as it is forced between driver and idler rollers 36, 38. Such a grasping characteristic is important in overcoming the tendency of item 68 from failing to completely pass between opposed surfaces 37, 39 of driver and idler rollers 36, 38. As shown in the drawing figures, gripping channels 86 are preferably formed in an inwardly-directed orientation so as to assist in maintaining item 68 in a centered location between the idler rollers.

A further aspect of the present invention is illustrated in FIG. 8B, wherein secondary notch 89 is preferably provided in one of driver and idler rollers 36, 38 for ensuring that the entire structure of the item to be crushed is fed between driver and idler rollers 36, 38. In a particular embodiment, secondary notch 89 is disposed adjacent to notch 72 at a relative position on driver roller 36 so as to come into contact with item 68 at about the time that a top portion 71 of item 68 reaches a compression point between driver and idler rollers 36, 38. Through such an orientation, secondary notch 89 assists in grasping the top portion 71 of item 68 while it is fed between driver and idler rollers 36, 38. In a particular application, such a secondary notch 89 inhibits can top 71 from breaking away from the remainder of item 68 and not being crushed in the apparatus of the present invention. Accordingly, secondary notch 89 assists in ensuring that each portion of item 68 is crushed between driver and idler rollers 36, 38.

Because crushing assembly 16 may encounter item 68 of various materials and constructions, it is important that driver and idler rollers 36, 38 be manufactured of a strong and durable material. Preferred materials for use in the manufacture of driver and idler rollers 36, 38 include, for example, steel, cast aluminum, and the like.

The invention has been described herein in considerable detail in order to comply with the patent statutes, and to provide those skilled in the art with the information needed to apply the novel principals and to construct and use embodiments of the invention as required. However, it is to be understood that the invention can be carried out by specifically different devices and that various modifications can be accomplished without departing from the scope of the invention itself.

What is claimed is:

1. An apparatus for crushing objects, said apparatus comprising:

(a) an inlet for serially feeding objects to said apparatus;

(b) a driver roller positioned below the inlet, said drive roller being rotatably driven about a first axis on a first drive shaft by a power input mechanism, said driver roller having a first notch;

(c) an idler roller rotatably coupled to said driver roller so as to be rotatably driven by said power input mechanism on a second drive shaft about a second axis that is substantially parallel to said first axis, an outer surface of said idler roller being biased into contact with an outer surface of said driver roller in an absence of said objects, said idler roller having a second notch wherein said first and second notches coordinate to at least partially receive said object therein throughout a portion of respective revolutions of said driver roller and said idler roller, said driver and idler rollers being mounted to their respective first and second drive shafts in specific predetermined relative orientations such that said first notch is rotationally offset from said second notch so that a grasping edge of said first notch is rotationally offset from a grasping edge of said second notch; and (d) a crushed object outlet positioned below said driver and idler rollers.

2. An apparatus as in claim 1 wherein said power input mechanism is an electric motor.

3. An apparatus as in claim 1 wherein said objects are aluminum beverage cans.

4. An apparatus as in claim 1, including a spring operably biasing said idler roller.

5. An apparatus as in claim 1 wherein said idler roller is rotatably coupled to said driver roller through intermeshed gears, such that said driver roller and said idler roller oppositely rotate relative to one another about their respective axes of rotation.

6. An apparatus as in claim 1 wherein the object is simultaneously disposed in both of said first and second notches.

7. An apparatus as in claim 1, including gripping channels disposed in an outer radial surface of at least one of said driver roller and said idler roller, said gripping channels being angularly oriented with respect to a rotational direction of said respective driver roller and idler roller, such that respective first ends of said gripping channels oriented towards said rotational direction are more inboard from respective outer axial ends of said respective driver roller and idler roller than respective second ends of said gripping channels, which second ends are oriented away from said rotational direction.

8. An apparatus as in claim 1, including a housing that substantially encloses said driver roller and said idler roller.

9. An apparatus as in claim 1, including a third notch disposed in one of said driver and idler rollers, said third notch being circumaxially adjacent to, but rotationally distanced from, a respective one of said first and second notches.

10. An apparatus as in claim 1 wherein said crushed object outlet is an outlet chute having a first end and a second end, said first end being disposed in adjacent juxtaposition with said driver roller and said idler roller.

11. An apparatus as in claim 7 wherein said first ends of said gripping channels are axially spaced from a radial equator of said respective driver roller and idler roller.

* * * * *